US007619568B2

(12) United States Patent
Gillette

(10) Patent No.: US 7,619,568 B2
(45) Date of Patent: Nov. 17, 2009

(54) PATCH ANTENNA INCLUDING SEPTA FOR BANDWIDTH CONTROL

(75) Inventor: Marlin R. Gillette, Brewerton, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 318 days.

(21) Appl. No.: 11/821,674

(22) Filed: Jun. 25, 2007

(65) Prior Publication Data

US 2008/0218418 A1 Sep. 11, 2008

Related U.S. Application Data

(63) Continuation-in-part of application No. 11/713,914, filed on Mar. 5, 2007, now Pat. No. 7,541,982.

(51) Int. Cl.
*H01Q 1/38* (2006.01)

(52) U.S. Cl. ..... 343/700 MS; 343/789

(58) Field of Classification Search ..... 343/700 MS, 343/789

See application file for complete search history.

(56) References Cited

U.S. PATENT DOCUMENTS

| | | | | |
|---|---|---|---|---|
| 5,400,040 | A * | 3/1995 | Lane et al. | 343/700 MS |
| 5,461,393 | A * | 10/1995 | Gordon | 343/769 |
| 5,471,221 | A * | 11/1995 | Nalbandian et al. | 343/700 MS |
| 5,561,435 | A * | 10/1996 | Nalbandian et al. | 343/700 MS |
| 5,694,135 | A | 12/1997 | Dikun et al. | |
| 5,861,848 | A * | 1/1999 | Iwasaki | 343/700 MS |
| 5,990,835 | A * | 11/1999 | Kuntzsch et al. | 343/700 MS |
| 6,184,833 | B1 | 2/2001 | Tran | |
| 6,225,959 | B1 * | 5/2001 | Gordon | 343/769 |
| 6,380,895 | B1 | 4/2002 | Moren et al. | |
| 6,538,614 | B2 | 3/2003 | Fleming et al. | |
| 6,825,809 | B2 * | 11/2004 | Aoki et al. | 343/700 MS |
| 6,914,787 | B2 * | 7/2005 | Ajioka et al. | 361/816 |
| 6,989,793 | B2 * | 1/2006 | Van Der Poel | 343/700 MS |
| 2004/0233648 | A1 * | 11/2004 | Ajioka et al. | 361/752 |
| 2007/0126638 | A1 * | 6/2007 | Channabasappa | 343/700 MS |

OTHER PUBLICATIONS

D.G. Fink et al., "Antennas and Wave Propagation", Chapter 18 of "Electronic Engineers Handbook 3rd Edition", McGraw-Hill, Inc., (1989), pp. 18-40-18-44.

(Continued)

*Primary Examiner*—Tho G Phan
(74) *Attorney, Agent, or Firm*—Howard IP Law Group, PC

(57) ABSTRACT

A patch antenna element includes a parasitic patch which is positioned on a top surface of a substrate. Located beneath the parasitic patch is a driven patch. The driven patch is coupled either directly or capacitively to the center conductor of a coaxial cable and hence provides a signal which signal is coupled to the parasitic patch. The parasitic patch, as well as the driven patch is surrounded by a metal wall cavity. The metal wall cavity increases mutual coupling between antenna patch elements of similar types. Disposed between the parasitic patch and the driven patch are septa elements. The septa elements are oriented parallel to the edges of the patch and are DC connected to the cavity metal sidewalls. The septa operate to reduce total cavity thickness and patch to patch mutual coupling while further allowing control of the bandwidth.

20 Claims, 7 Drawing Sheets

OTHER PUBLICATIONS

G. Kumar & K.P. Ray, "Broadband Microstrip Antennas", AirTech House (2003), p. 62.

Luk, K.M. et al., "Broadband Microstrip Patch Antenna", Electronics Letters, vol. 34, 1998, pp. 1442-1443.

Mak, C.L., K.F. Lee, and K. M. Luk, "A Novel Broadband Patch Antenna with a T-shaped Probe, "IEEE Proc. Microwaves, Antennas Propagation, Pt. H, vol. 147, 2000, pp. 73-76.

International Search Report dated Jun. 5, 2008.

Soh et al., "Comparative Radiation Performance of Different Feeding Techniques for a Microstrip Patch Antenna", 2005 Asia-Pacific Conference on Applied Electromagnetics Proceedings, pp. 35-40, Dec. 20-21, 2005.

A.F. Peterson, "Analysis of Probe-Fed Circular Microstrip Patches Backed by Circular Cavities", Electromagnetics, 14, pp. 239-258, 1994.

W.Swelam et al., "Broad-Band U-Slot Rectangular Patch Antenna on a Microwave Substrate Using a Novel Feeding Technique", IEEE, pp. 533-536, 2005.

F. Zavosh and James T. Aberle, "Single and Stacked Circular Microstrip Patch Antennas Backed by a Circular Cavity", IEEE Transactions on Antennas and Propagation, vol. 43, pp. 746-750, No. 7, Jul. 1995.

Ghannoum et al., "Probe Fed Stacked Patch Antenna for UWB Sectoral Applications", IEEE, pp. 97-102.

Mitchell et al., "Search for High-Performance Probe-Fed Stacked Patches Using Optimization", IEEE Transactions on Antennas and Propagation, vol. 51, pp. 249-255, No. 2, Feb. 2003.

Bahnacy et al., "Stacked L-Shaped Probe Fed Microstrip Antenna", IEEE, pp. 210-213, 2000.

* cited by examiner

PATCH ANTENNA INCLUDING SEPTA FOR BANDWIDTH CONTROL

RELATED APPLICATION

This application is a continuation-in-part of application Ser. No. 11/713,914 filed on Mar. 5, 2007 now U.S. Pat No. 7,541,982, entitled "TUNING APPARATUS FOR A PROBE FED PATCH ANTENNA", the subject matter thereof incorporated by reference herein.

FIELD OF THE INVENTION

The present invention relates to a microstrip antenna and more particularly to a microstrip antenna or patch antenna with septa for bandwidth control, and reduction of antenna element thickness.

BACKGROUND OF THE INVENTION

Microstrip patch antennas have several well known advantages over other antenna structures. These antennas generally have a low profile and conformal nature, are lightweight, have low production cost, are robust in nature and compatible with microwave monolithic integrated circuits (MMICs) and opto-electronic integrated circuits (OEICs) technologies. However, one drawback of such devices is their relatively narrow bandwidth. In order to achieve wider bandwidth, a relatively thick substrate must be used. However, the antenna substrate supports tightly bound surface wave modes which represent a loss mechanism in the antenna. The loss due to surface wave modes increases as the substrate thickness is increased. It is desirable to develop conformal microstip antennas which enjoy wide bandwidth, yet do not suffer from the loss of attractive features of the conventional microstrip patch antenna.

One way to enhance the mutual coupling antenna element-to-antenna element performance is to surround the patch elements with metal walls. This technique effectively prevents surface wave modes from being excited in a substrate, thus allowing the substrate's thickness to be increased without serious effects. In addition to the common techniques of increasing patch height and decreasing substrate permittivity, a conventional method uses parasitic patches in another layer (stacked geometry). However, this has the disadvantage of increasing the thickness of the antenna. Parasitic patches can also be used in the same layer (coplanar geometry); however, this undesirably increases the lateral size of the antenna and is not suitable for antenna array applications.

In many applications, such as phased array radars, low profile antennas are required; therefore, microstrip antennas are often utilized. The microstrip antenna is constructed on a thin dielectric sheet using printed circuit board and etching techniques. Three common geometries, rectangular, square and round, are widely employed. Circular polarized radiation can be obtained by exciting the square or round element at two feed points 90° (degrees) apart and in quadrature phase. A direct probe connected patch antenna element which is suitable for application at low UHF frequencies is required for a phased array application. The impedance matching of such an antenna should be compact, mechanically simple, and take advantage of the volume occupied by the patch antenna element. A broad band antenna element requires the use of thick substrates with low relative dielectric constants approaching that of air.

As indicated above, patch antenna elements are employed in phased array radars and other phased array situations where low profile antenna elements are required. A patch antenna array often is constructed as a single printed circuit board with ground plane on one side and patches on the second radiating side. See for example, the above-noted patent application entitled, "Tuning Apparatus For A Probe Fed Patch Antenna", filed on Mar. 5, 2007 having Ser. No. 11/713,914. That application describes microstrip patch antennas and more particularly a tuning apparatus for such an antenna. The application also shows the above-noted patch antenna array configuration. In any event, in a patch antenna array the individual patches are often open laterally. The laterally open substrate can support surface waves and mutual coupling between adjacent antenna elements is strong. A method to reduce mutual coupling is to mount individual patch elements in metallic cavities. The cavity mount structure prevents propagation of surface waves in substrates since the substrate's size is limited to the immediate area around each patch.

In a phased antenna array, each antenna element may be required to be individually removable. The patch antenna element typically is required to fit a physical lateral envelope of about 0.5 by 0.5 wavelengths and also to accommodate a specified total thickness. A metal wall cavity structure is able to reduce the antenna element to antenna element mutual coupling. The presence of metal cavity sidewalls near a stacked patch configuration increases the coupling co-efficient between the stacked patches.

As one will understand, the present invention discloses the use of septa or partitions to control coupling coefficients from patch to patch. The use of septa allows for reduction of total cavity thickness and enables improved bandwidth control.

SUMMARY OF THE INVENTION

A patch antenna element, comprising, a substrate having a top and bottom surface, at least one first metal patch having a given area located on the top surface of the substrate, at least a second metal patch positioned below the top surface of the substrate and aligned in area with the first patch, a metal cavity surrounding the first and second metal patches, first septa connected to the walls of the cavity and positioned between the first and second patches and operative to control the bandwidth of the patch antenna.

A method for controlling bandwidth of a patch antenna comprises: providing a metal housing cavity; providing a dielectric material; disposing in the metal cavity a first metal patch having a given area located on a top surface of the dielectric material; disposing in the metal cavity a second metal patch below the top surface of the dielectric material and aligned in areas with the first patch, and providing septa connected to the walls of the cavity and between the first and second patches.

A patch antenna element comprising: a dielectric material, a first metal patch located on a top surface of the dielectric material, a second metal patch positioned below the top surface of the dielectric material and aligned with the first patch, a metal cavity surrounding the first and second metal patches, septa positioned between the first and second patches and operative to control the bandwidth of the patch antenna.

A patch antenna element includes a parasitic patch which is positioned on a top surface of a substrate. Located beneath the parasitic patch is a driven patch. The driven patch is coupled either directly or capacitively to the center conductor of a coaxial cable and hence provides a signal which signal is coupled to the parasitic patch. The parasitic patch, as well as the driven patch is surrounded by a metal wall cavity. The metal wall cavity increases mutual coupling between antenna patch elements of similar types. Disposed between the parasitic patch and the driven patch are septa elements. The septa elements are oriented parallel to the edges of the patch and are DC connected to the cavity metal sidewalls. The septa operate to reduce total cavity thickness and patch to patch mutual coupling while further allowing control of the bandwidth.

DETAILED DESCRIPTION OF THE PREFERRED EMBODIMENTS

Figure 1:
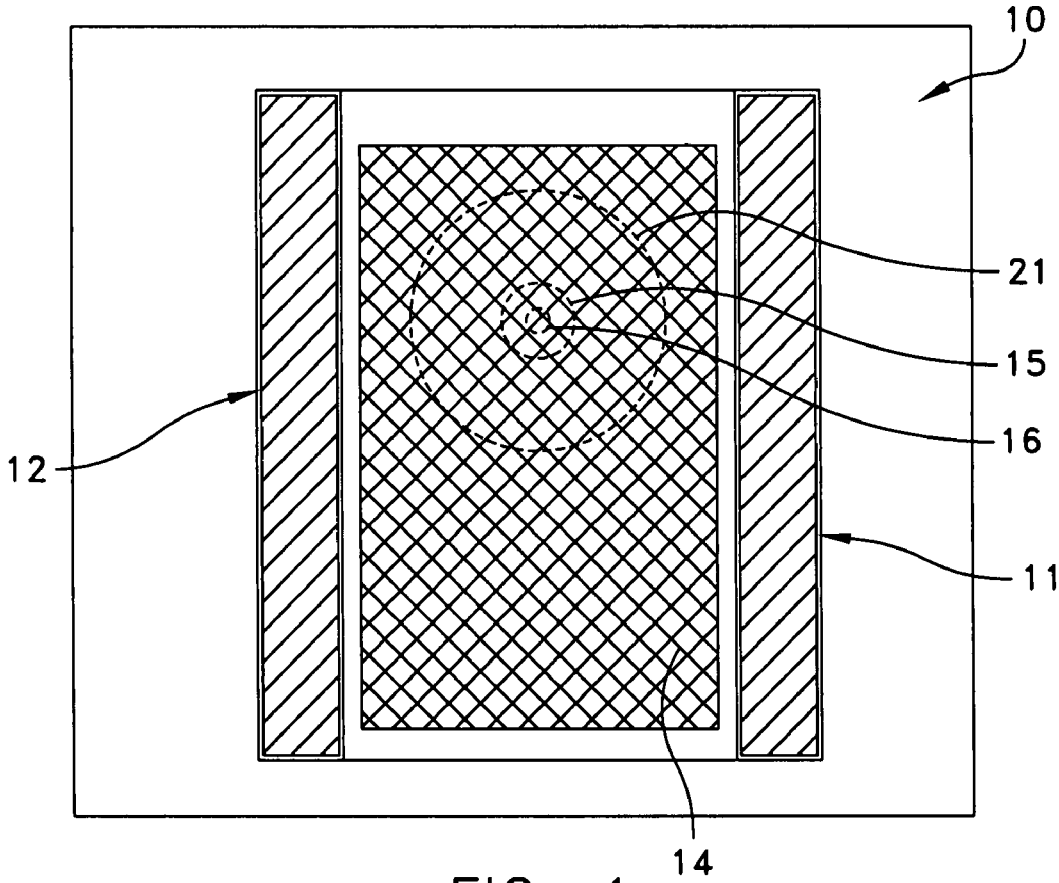
FIG. 1 is a top plan schematic view depicting a patch antenna configuration according to an embodiment of the invention.
Figure 2:
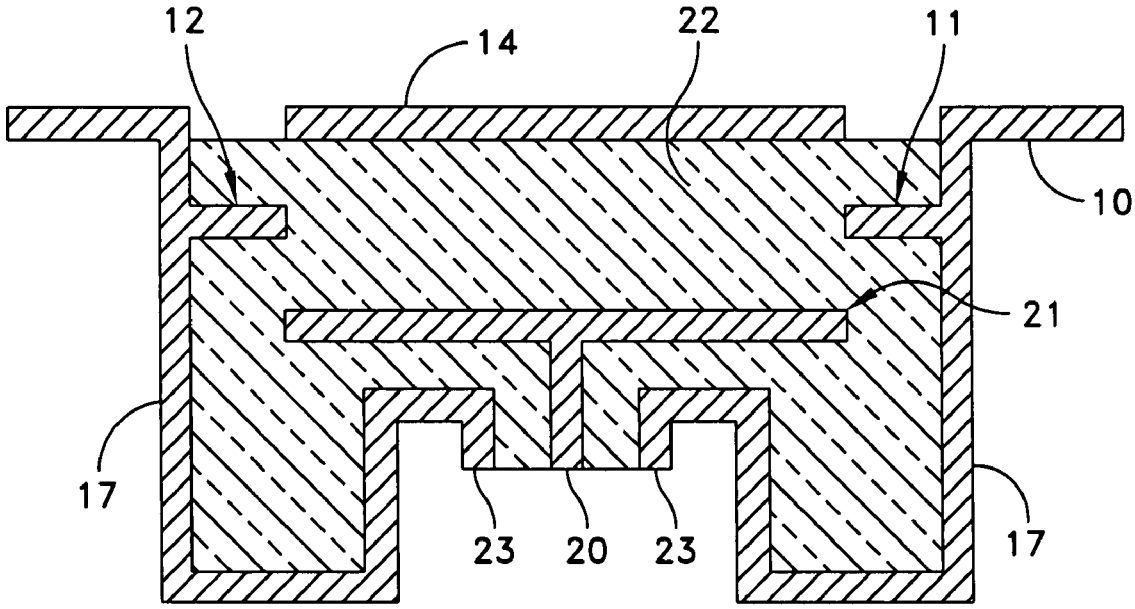
FIG. 2 is a cross-sectional schematic view of the patch antenna of FIG. 1, depicting a patch antenna employing a direct driven probe using shunt/parallel tuning circuit and septa for bandwidth control.

Referring to FIG. 1, there is shown a top plan schematic view of a patch antenna employing septa according to an exemplary embodiment of this invention. Reference numeral 10 refers to a metal housing cavity which contains a patch antenna. In an exemplary embodiment, the metal housing cavity comprises a metallized surface electro-plated on a plastic or composite core dielectric. The patch antenna has a top metal patch 14 which is disposed and positioned on the surface of a dielectric material. Beneath the patch, there is a shown a coaxial transmission line consisting of a center conductor 16 surrounded by a shield 15. The patch 14 as indicated is disposed upon the surface of a dielectric material. The septa are shown as elements 11 and 12. Each septum as will be more clearly seen in FIG. 2, is positioned between a top parasitic patch (identified as patch 14) and a bottom direct driven patch (identified as patch 21). Referring to FIG. 2, the septa 11, 12 are positioned midway between the dual patches 14, 21 of the patch antenna array. The septa are oriented parallel to the edges of the patch long dimension on a DC connection to the cavity metal sidewalls. The septa can be considered to have the same function as the double vane iris of a wave guide filter construction. The use of septa or metal partitions enables reduction of total cavity thickness and allows for bandwidth control.

As indicated above, the stacked patch antenna element is required to fit a physical lateral envelope of about one half by one half wavelengths and to fit a specified total thickness. The metal wall cavity structure or housing 10 is able to reduce the antenna element to antenna element mutual coupling in the array. The inclusion of the metal cavity metal walls has the effect of increasing the coupling between the patches in a stacked configuration. The control of patch to patch coupling or bandwidth forces the total thickness to increase when coupling or bandwidth is to be reduced. By the use of the septa as 11 and 12, and positioning the septa midway between the patches as for example, midway between the parasitic patch and the driven patch provides a reduction of total cavity thickness and further depending upon the size of the septa, allows bandwidth control by reducing the mutual coupling between stacked patches. The septa as seen are oriented parallel to the edges of the patch long dimension and are DC connected to the cavity metal sidewalls on three sides.

Referring to FIG. 2, wherein the same reference numerals have been employed in regard to those of FIG. 1, the parasitic patch 14 is positioned on a dielectric layer 22. The dielectric layer or dielectric substrate 22 may be a foam substrate of a given dielectric commonly employed in a microstrip antenna. The dielectric substrate 22 may comprise one or more layers of dielectric material. The parasitic patch 14 is surrounded by a metal housing or metal cavity 10. The cavity 10 has sidewalls as 17. Connected to the sidewalls of the cavity are the septa 11 and 12. Also seen, positioned below the parasitic patch 14 is a direct driven patch 21. The driven patch 21 is DC connected to the center conductor 20 of a coaxial cable. The coaxial cable or shield is shown as 23 and is also connected to the metal housing cavity 10.

As one can ascertain, the structure depicted in FIGS. 1 and 2 may be circular, round (e.g. circular, substantially circular, oval, elliptical, etc.) or rectangular for example, a circular, round or rectangular microstrip antenna. Such geometric configurations and/or other such configurations can be employed as is understood by one of ordinary skill in the art. The dielectric substrate 22 may comprise a foam substrate, a Teflon substrate, or other such dielectric substrate types. The metal patches as for example 14 and 21 may be a suitable metal such as copper, or a precious metal for high frequency operation, by way of example only.

Figure 3:
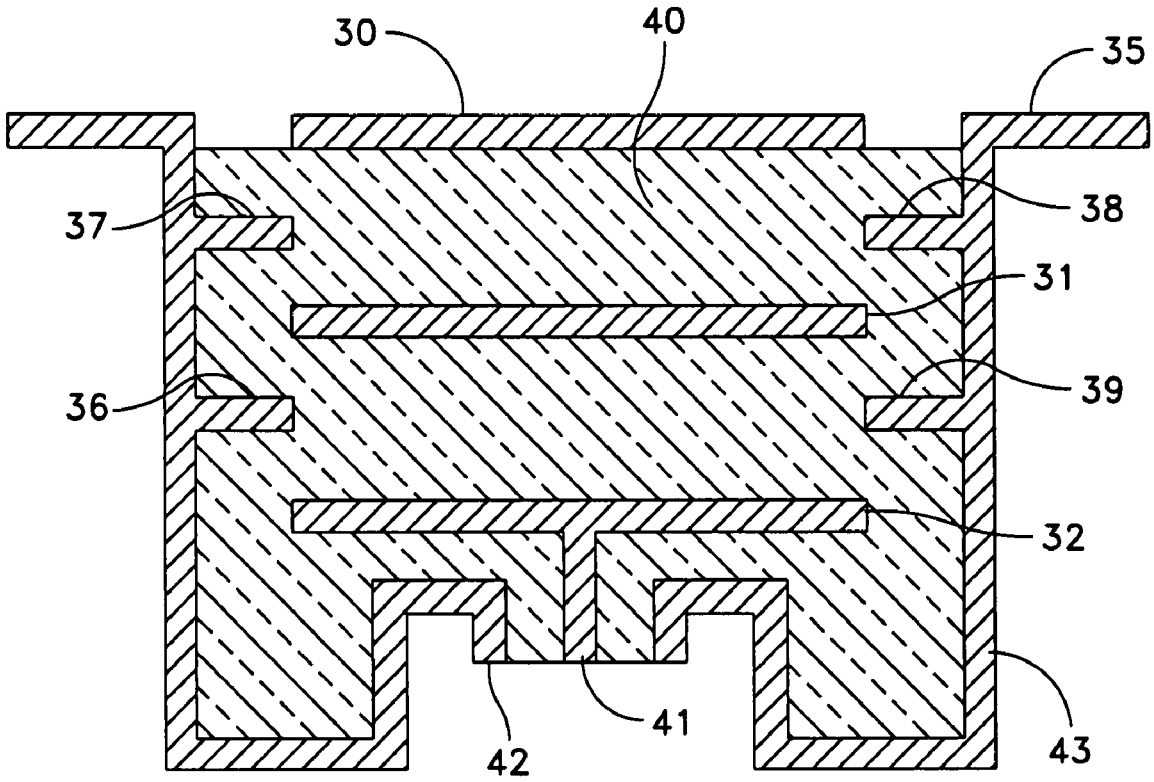
FIG. 3 is a cross-sectional schematic view of a patch antenna employing a direct driven probe using shunt/parallel tuning circuit with multiple septa for bandwidth control, and using three stacked patches according to an embodiment of the invention.

Referring to FIG. 3, there is shown a cross-sectional schematic view of an antenna configuration according to an embodiment of the invention. A direct probe driven patch 32 is driven by a coaxial transmission line. The coaxial transmission line has a center conductor 41 which is DC connected to the metal patch 32. The center conductor 41 is surrounded by a shield 42 which is connected to the metal wall 43 of the metal cavity or housing 35. A first parasitic patch 30 is positioned on the top surface of the dielectric substrate 40. A second parasitic patch 31 is positioned below the first parasitic patch and above the direct driven patch 32. The second patch 31 as seen is positioned midway between the direct driven patch 32 and the first parasitic patch 30. Located between the respective patches are septa, as shown by septa 37 and 38 located between the first parasitic patch 30 and the second parasitic patch 31 as well as septa 36 and 39 located between the second parasitic patch 31 and the driven patch 32.

As indicated the septa allow bandwidth control as seen in FIG. 3 for three stacked patches indicated as patches 30, 31 and 32. The patch antenna as depicted in FIGS. 1, 2 and 3 employ shunt/parallel tuning circuits. One can utilize series resonance in conjunction with the patch antenna.

Figure 4:
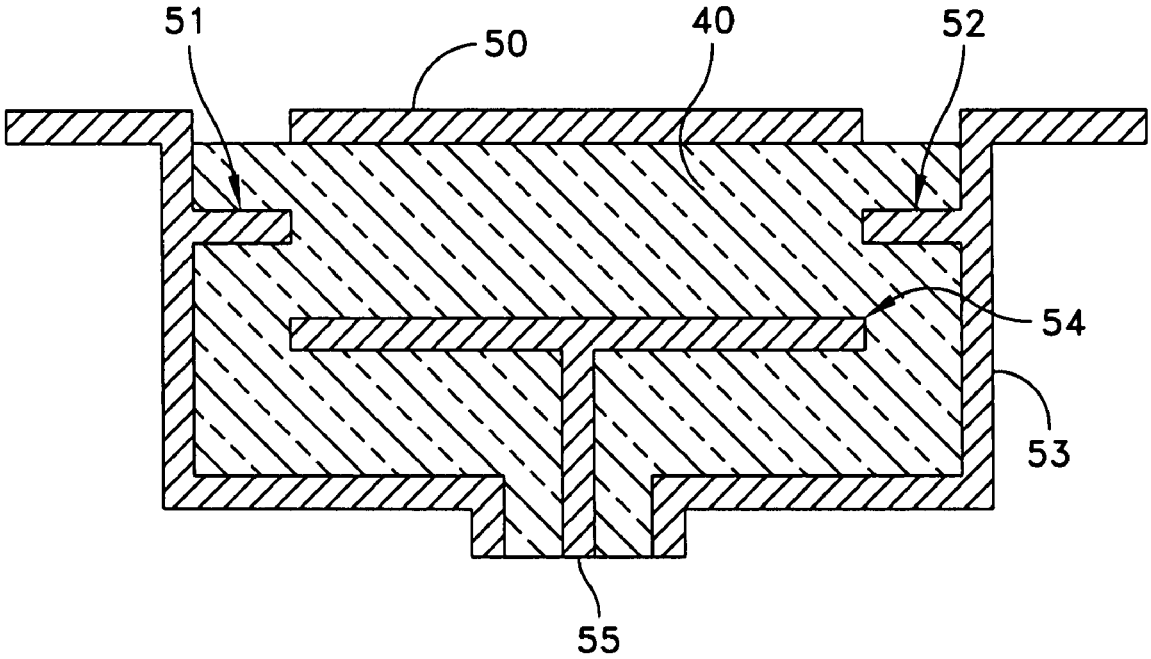
FIG. 4 is a cross-sectional schematic view of a patch antenna employing a direct driven probe without shunt/parallel tuning and employing septa for bandwidth control according to an embodiment of the invention.

Referring to FIG. 4, there is shown a cross-sectional schematic view of a patch antenna configuration using a direct driven probe without shun/parallel tuning and employing septa for bandwidth control according to an embodiment of the invention. A direct probe driven patch 54 is DC connected to the input center conductor 55 of an input coaxial transmission line. The patch 54 is positioned below parasitic patch 50, which again is positioned on the surface of a dielectric layer or substrate 40. The septa which are metal and are depicted as 51 and 52 are positioned between the driven patch 54 and the parasitic patch 50 preferably midway between the two patches. The configuration illustrated in FIG. 4 does not have shunt/parallel tuning as there is no shield or surrounding conductor associated with center conductor 55 of the input coaxial transmission line.

In any event, the septa 51 and 52 are provided for bandwidth control and operate to do so. The metal wall cavity structure is able to reduce antenna element to antenna element mutual coupling. The inclusion of the metal cavity walls has the effect of increasing the coupling between the patches in a stacked configuration. The control of patch to patch coupling or bandwidth forces the total thickness to increase when coupling or bandwidth is to be reduced. By placing the septa midway between the dual patches and orienting the septa parallel to the edges of the longest side of the patch, one is able to provide a reduction in total cavity thickness while the septa further allow bandwidth control. The septa are directly coupled to the metal cavity walls and as indicated operate to enable one to control bandwidth.

As shown herein, embodiments of the present invention reduce complexity in large finite antenna arrays and enable a less complex structure that is dimensionally tolerant. Embodiments of the invention also do not require exotic high dielectric constant materials in the cavity wherein slots and other antenna configurations are necessary. The cavity thickness is reduced by the use of the septa to control patch to patch coupling coefficients. The result is a reduced weight antenna including a reduction in the antenna array support structure.

Figure 5:
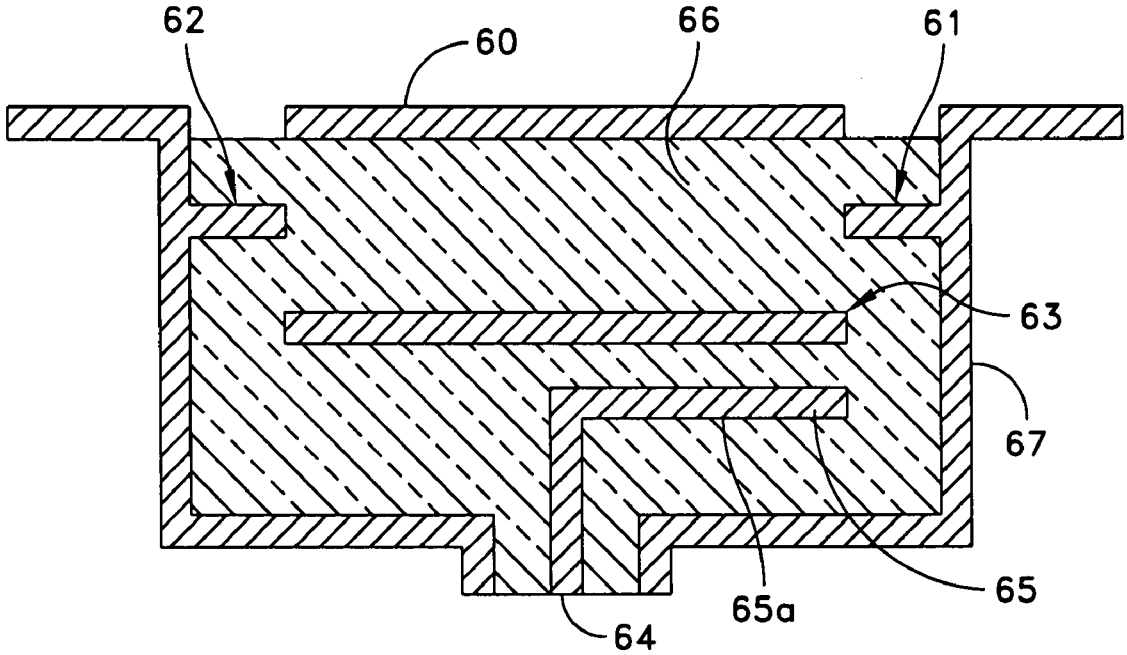
FIG. 5 is a cross-sectional schematic view of a patch antenna configuration using an L-shaped probe driving a patch and employing septa for bandwidth control according to an embodiment of the invention.

Referring to FIG. 5, there is shown a series compensated probe driven patch antenna employing a L-shaped probe structure 65. The configuration depicted in FIG. 5 using L probe 65 allows for series compensating of two stacked patches 60, 63. As seen in FIG. 5, the parasitic patch 60 is disposed on the top surface of a dielectric material 66. A driven patch 63 is in close proximity to L shape probe 65 having a center conductor 64 and an extending arm 65*a*. The probe as seen in FIG. 5 has an angled shape in the form of an L shape and therefore the term L probe is used. The L probe is not DC connected to the driven patch 63 but drives the driven patch by means of capacitive coupling. The septa 61 and 62 are shown positioned between the parasitic and driven patches 60, 63 and connected to the metallic walls of the cavity or housing 67.

As indicated previously, the patch antenna array is often constructed as a single printed circuit board with a ground plane on one side and patches with feed networks on the second radiating side. In prior art the integral patches are opened laterally. The laterally opened substrate can support surface waves and mutual coupling between adjacent antenna elements. This coupling can be extremely strong and therefore affect antenna performance. The prior art used a method to reduce mutual coupling by mounting individual patch elements in individual metallic cavities. The cavity mount structure prevents propagation of surface waves in substrates since the substrate size is limited to the immediate area around each patch. However, by using a metal wall cavity structure, one can reduce antenna element to antenna element mutual coupling. By inclusion of septa which are preferably positioned midway between the patches, as shown, and are oriented parallel to the edges of the patch, the septa operate to reduce total cavity thickness and allow for efficient bandwidth control.

Figure 6:
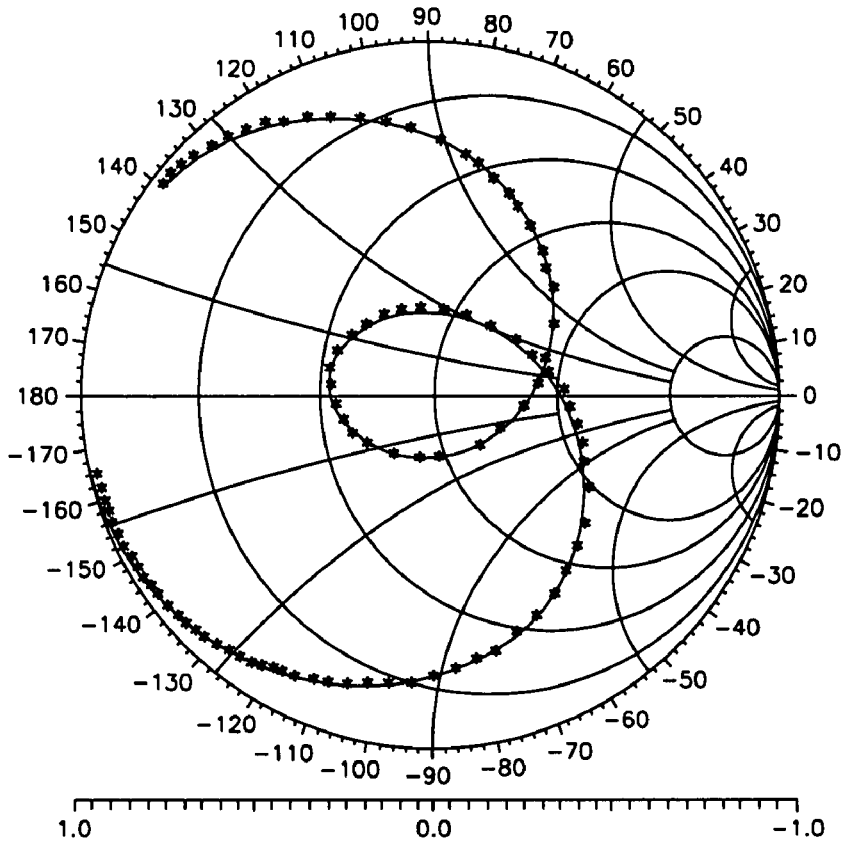
FIG. 6 is a Smith diagram depicting the input impedance for two stacked patches using septa to control patch to patch mutual coupling.

Referring to FIG. 6, there is shown a Smith chart depicting the input impedance for two stacked patches using septa to control patch to patch mutual coupling.

Figure 7:
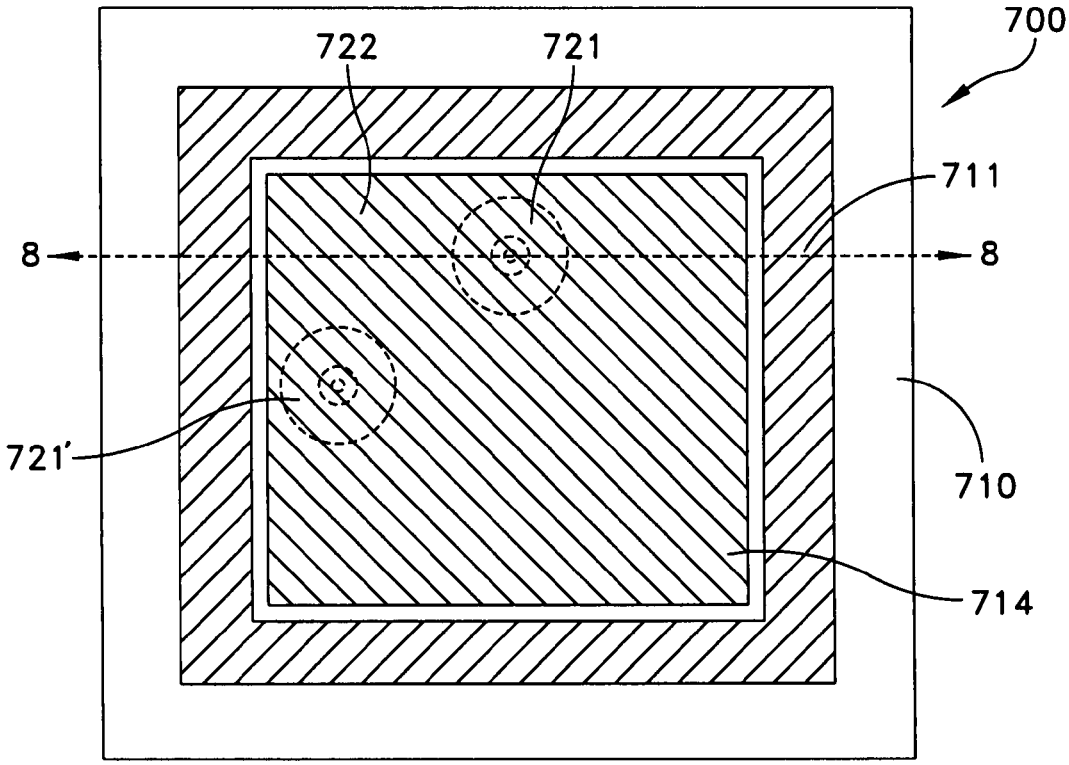
FIG. 7 is a top plan schematic view of a patch antenna configuration having a square patch with orthogonal probes and square septum according to an embodiment of the invention.
Figure 8:
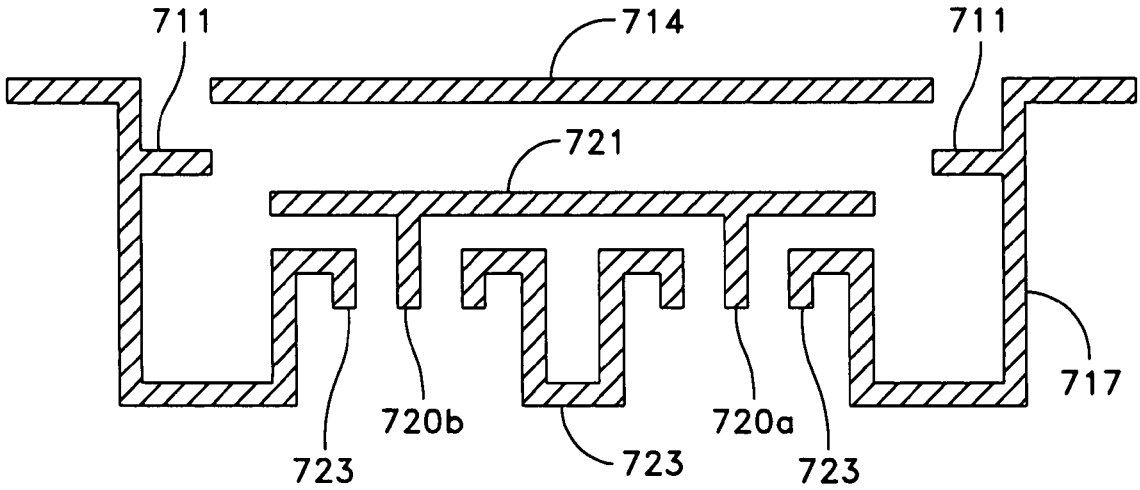
FIG. 8 is a cross-sectional schematic view of a patch antenna of FIG. 7 employing a pair of direct driven probes according to an embodiment of the invention.

Referring now to FIG. 7 in conjunction with FIG. 8, there is shown another embodiment of a patch antenna configuration 700 (similar to that of FIG. 1) but having a square patch with orthogonal probes and square septum 711 according to an embodiment of the invention. The configuration 700 includes a metal housing cavity 710 having sidewalls 717. A pair of patch antenna elements 721, 721' are shown in the top view of FIG. 7. Orthogonal probes of dual polarization or circular polarization are mounted in the cavity with square septum 711 as illustrated in the cross-sectional view of FIG. 8 taken along lines 1-1. The patch antenna has a top metal patch 714 which is disposed and positioned on the surface of a dielectric material 722. Square patch 721 is driven by orthogonal shunt tuned direct connected probes as shown by coaxial input transmission lines 720*a* and 720*b*. The square septum 711 is disposed midway between elements 714 and 721. The probes may be directed connected and/or implemented as L-probes as discussed in conjunction with FIGS. 4 and 5. Shield 723 connected to housing 710 serves to protect the antenna element configuration.

Figure 9:
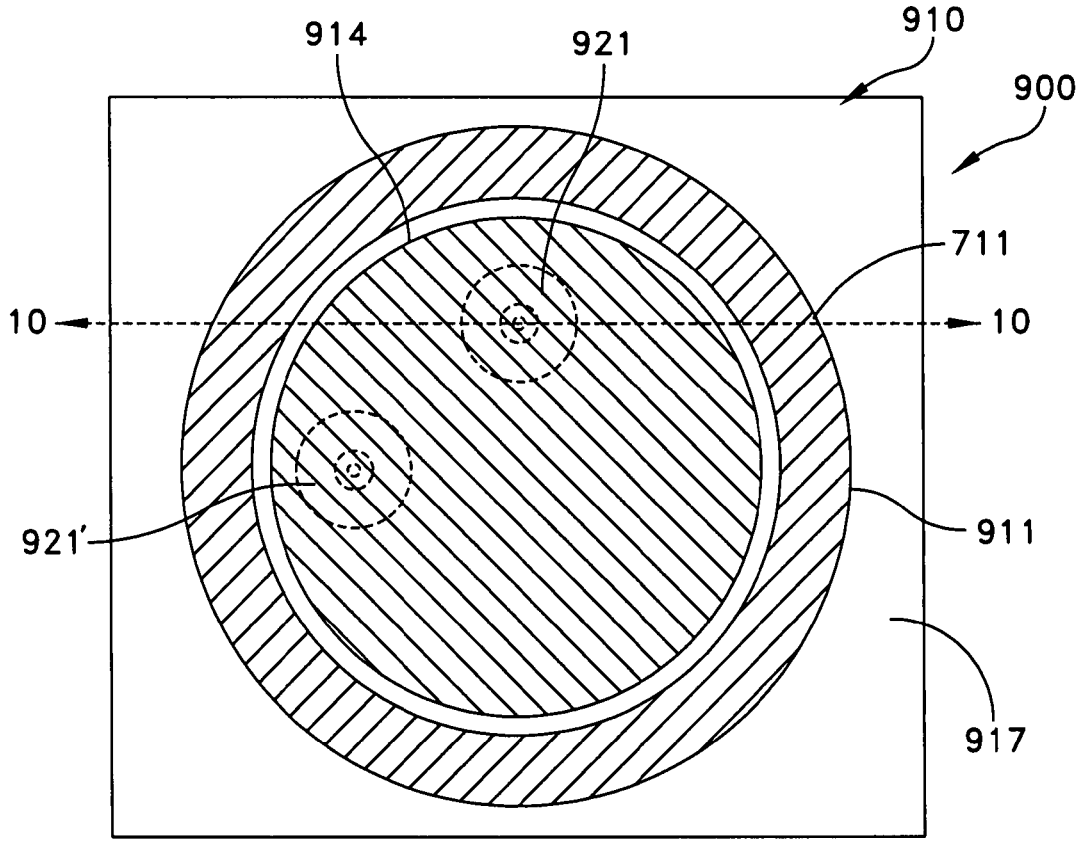
FIG. 9 is a top plan schematic view of a patch antenna configuration having a round patch with orthogonal probes and round septum according to an embodiment of the invention.
Figure 10:
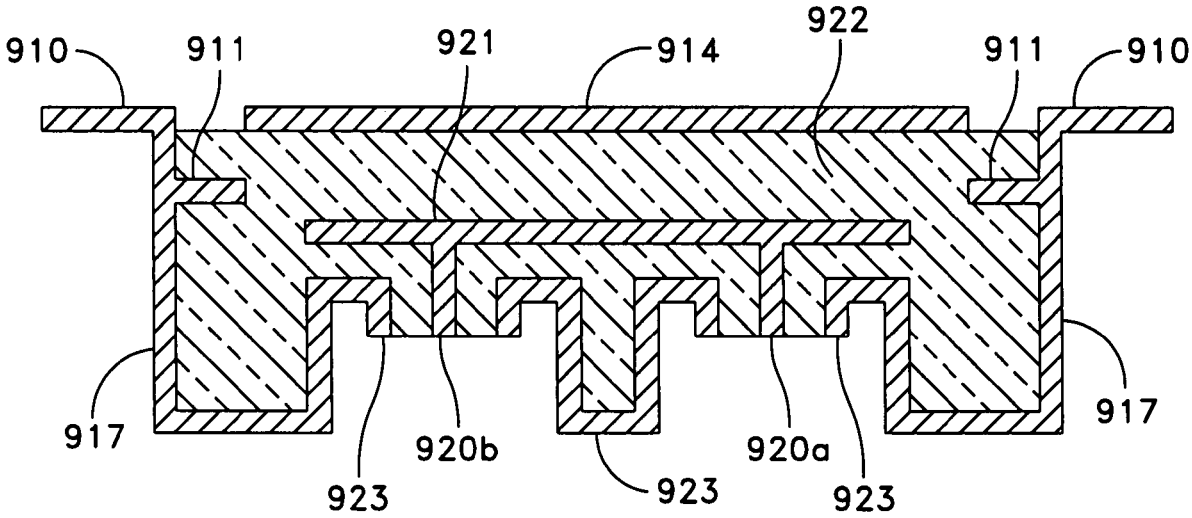
FIG. 10 is a cross-sectional schematic view of a patch antenna of FIG. 8 employing a pair of direct driven probes according to an embodiment of the invention.

Referring now to FIG. 9 in conjunction with FIG. 10, there is shown another embodiment of a patch antenna configuration 900 (similar to that of FIGS. 1 and 7) but having a round patch with orthogonal probes and round septum 911 according to an embodiment of the invention. The configuration 900 includes a metal housing cavity 910 having sidewalls 917. A pair of patch antenna elements 921, 921' are shown in the top view of FIG. 9. Orthogonal probes of dual polarization or circular polarization are mounted in the cavity with round septum 911 as illustrated in the cross-sectional view of FIG. 10 taken along lines 1-1. The patch antenna has a top metal patch 914 which is disposed and positioned on the surface of a dielectric material 922. Round patch 921 is driven by orthogonal shunt tuned direct connected probes as shown by coaxial input transmission lines 920*a* and 920*b*. The round septum 911 is disposed midway between elements 914 and 921. The probes may be directed connected and/or implemented as L-probes as discussed in conjunction with FIGS. 4 and 5. Shield 923 connected to housing 910 is the outer coaxial housing for center conductors 920*a* and 920*b*.

Figure 11:
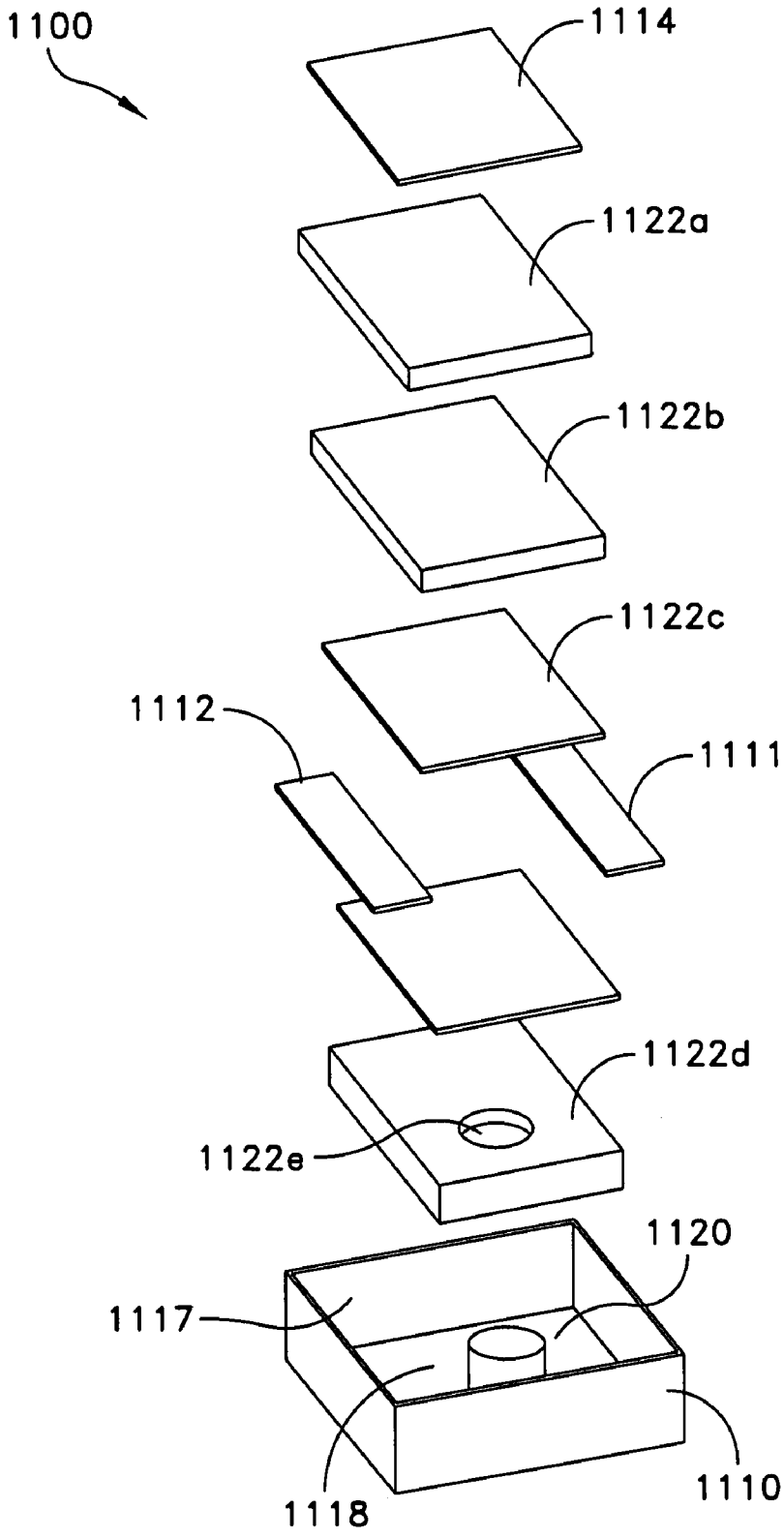
FIG. 11 is an exploded view of a patch antenna configuration according to an embodiment of the invention.

Referring now to FIG. 11 there is shown an exploded view of a patch antenna configuration 1100 according to an embodiment of the invention. As shown, reference numeral 1110 refers to a metal housing cavity which contains a patch antenna. The patch antenna has a top metal patch 1114 which is disposed and positioned on the surface of a dielectric material 1122. The septa are shown as elements 1111 and 1112. Each septum is positioned between the top parasitic patch as patch 1114 and a bottom direct driven patch 1121 midway between the dual patches of the patch antenna array. The septa are oriented parallel to the edges of the patch long dimension on a DC connection to the cavity metal sidewalls 1117.

The dielectric layer or dielectric substrate comprises a plurality of dielectric material layers indicated as 1122*a*, 1122*b*,1122*c*, and 1122*d*. Each layer may be a foam substrate of a given dielectric commonly employed in a microstrip antenna. As shown in the exemplary embodiment, the dielectric layer 1122*d* includes an aperture 1122*e* for receiving a probe or probe adaptor 1120 integral to the housing and which is direct connected to patch 1121 for driving the patch via electronic connections 1120*a* through the probe.

Figure 12:
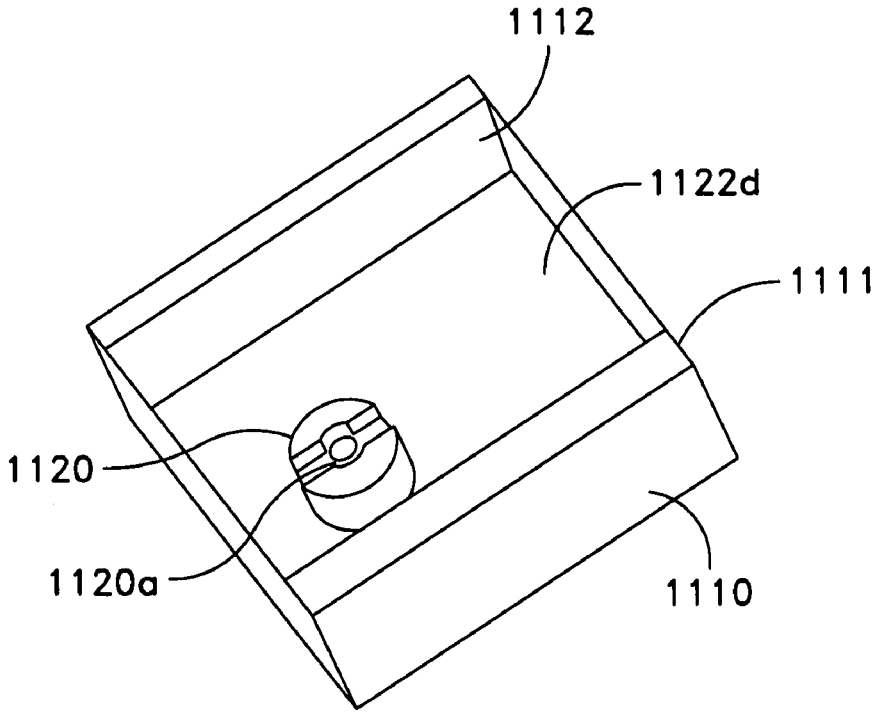
FIG. 12 is a perspective schematic top view of a partially assembled patch antenna configuration according to an embodiment of the invention.
Figure 13:
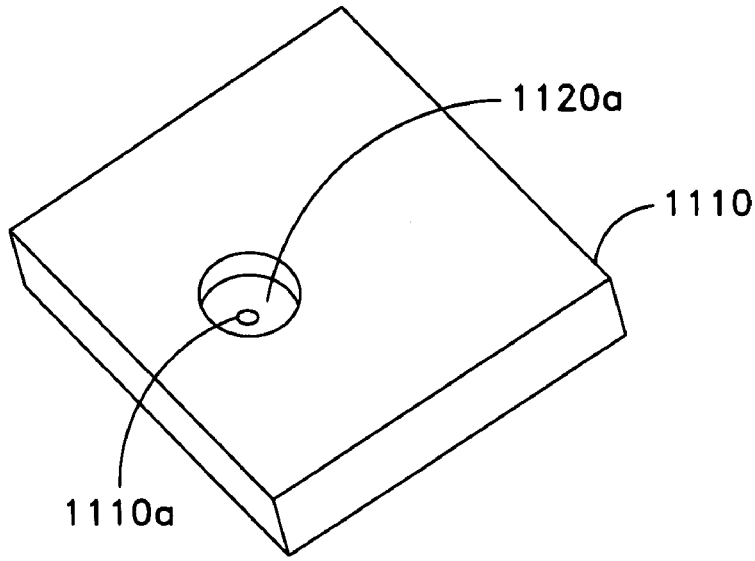
FIG. 13 is a perspective schematic bottom view of a partially assembled patch antenna configuration according to an embodiment of the invention.

FIG. 12 is a perspective schematic top view showing a partially assembled patch antenna configuration having components as indicated in FIG. 11. As illustrated, the housing 1110 encompasses or contains probe adaptor 1120 which is surrounded by dielectric layer 1122*d*. Septa 1111 and 1112 extend from sidewalls of the housing. The driven patch 1121, additional dielectric layers 1122*a-c* and parasitic patch 1124 are not shown in the partially assembled configuration depicted in FIG. 12. FIG. 13 shows a perspective schematic bottom view of the partially assembled patch antenna configuration of FIG. 12 wherein like reference numerals have been used to indicate like parts. As shown, the metal housing 1110 accepts probe 1120 and/or electrical connections/conductors 1120*a* through an aperture in the metal cavity designated as 1110*a*.

It will be apparent to those skilled in the art that modifications and variations may be made in the apparatus and process of the present invention without departing from the spirit or scope of the invention. It is intended that the present invention cover the modification and variations of this invention provided they come within the scope of the appended claims and their equivalents.

What is claimed is:

1. A patch antenna element, comprising:

a substrate having a top and bottom surface, at least one first metal patch having a given area located on said top surface of said substrate, at least a second metal patch positioned below said top surface of said substrate and aligned in areas with said first patch, a metal cavity surrounding said first and second metal patches, first septa connected to the walls of said cavity and positioned between said first and second patches and operative to control the bandwidth of said patch antenna.

2. The patch antenna element according to claim 1, wherein said first and second patches are generally rectangular in shape.

3. The patch antenna element according to claim 2, wherein said septa are oriented parallel to the long edges of said rectangular patch.

4. The patch antenna element according to claim 1, further comprising a third patch located between said first and second patches, with second septa located between said third and second patches.

5. The patch antenna according to claim 1, further comprising a coaxial cable structure having a center conductor connected to said second metal patch.

6. The patch antenna according to claim 1, further comprising:

an L-shaped probe positioned in close proximity to said second patch to enable signal power propagating on said probe to capacitively couple to said second patch.

7. The patch antenna according to claim 1, wherein said second patch is direct connected to two coaxial input transmission lines.

8. The patch antenna according to claim 1, wherein said first and second patches are round microstrip patches.

9. The patch antenna according to claim 1, wherein said first and second patches are rectangular microstrip patches.

10. The patch antenna according to claim 1, wherein said substrate is a foam dielectric material.

11. The patch antenna according to claim 1, wherein the metal cavity comprises a metallized surface electro-plated on a plastic or composite core dielectric.

12. A patch antenna element, comprising:

a dielectric material, a first metal patch located on a top surface of said dielectric material, a second metal patch positioned below said top surface of said dielectric material and aligned with said first patch, a metal cavity surrounding said first and second metal patches, septa positioned between said first and second patches and operative to control the bandwidth of said patch antenna.

13. The patch antenna element according to claim 12, wherein the septa are connected to the sidewalls of the metal cavity and positioned orthogonal thereto.

14. The patch antenna element according to claim 12, wherein the septa are midway between the first and second metal patches and are oriented parallel to the edges of the patches and are DC connected to the metal cavity sidewalls.

15. The patch antenna element according to claim 12, further comprising a coaxial cable structure having a center conductor connected to said second metal patch.

16. The patch antenna element according to claim 12, wherein the dielectric material comprises a first dielectric layer between the first and second metal patches, and a second dielectric layer between the second metal patch and the floor of the metal cavity.

17. The patch antenna element according to claim 16, wherein a probe extends from the floor of the metal cavity for electrically connecting to said second metal patch through the second dielectric layer.

18. The patch antenna element according to claim 17, wherein the second dielectric layer includes an aperture for accommodating said probe.

19. A method for controlling bandwidth of a patch antenna comprising:

providing a metal housing cavity;

providing a dielectric material;

disposing in said metal cavity a first metal patch having a given area located on a top surface of said dielectric material;

disposing in said metal cavity a second metal patch below said top surface of said dielectric material and aligned in areas with said first patch, and providing septa connected to the walls of said cavity and between said first and second patches.

20. The method according to claim 19, wherein providing the dielectric material comprises providing at least a first dielectric layer between a bottom surface of the first metal patch and a top surface of the second metal patch; and providing at least a second dielectric layer between a bottom surface of the second metal patch and a floor of the metal housing cavity.

* * * * *